US006550170B1

(12) United States Patent
Cooper et al.

(10) Patent No.: US 6,550,170 B1
(45) Date of Patent: Apr. 22, 2003

(54) POLE-MOUNTED SIGN

(76) Inventors: Garry Cooper, 7 Howard Crescent, Barrie, Ontario L4M 2L7 (CA); Murray Wright, 3 Springdale Crescent, Barrie, Ontario L4N 2S2 (CA)

( * ) Notice: Subject to any disclaimer, the term of this patent is extended or adjusted under 35 U.S.C. 154(b) by 0 days.

(21) Appl. No.: 09/722,558

(22) Filed: Nov. 28, 2000

(51) Int. Cl.[7] ..... G09F 15/00
(52) U.S. Cl. ..... 40/607; 248/218.4
(58) Field of Search ..... 40/607, 611, 606, 40/612; 248/219.4, 218.4

(56) References Cited

U.S. PATENT DOCUMENTS 3,310,899 A * 3/1967 Hart et al. ..... 40/604
3,593,450 A * 7/1971 Mollet et al. ..... 40/607
3,612,460 A * 10/1971 Smith ..... 40/607
4,095,360 A * 6/1978 Dinan et al. ..... 40/603
4,706,400 A * 11/1987 Howard et al. ..... 40/617
4,880,195 A * 11/1989 Lepley ..... 248/219.4
5,212,898 A * 5/1993 Dinan et al. ..... 40/607
5,335,889 A * 8/1994 Hopkins et al. ..... 248/231.81
5,359,797 A * 11/1994 Williamson ..... 280/816
5,428,913 A * 7/1995 Hillstrom ..... 40/604
5,463,973 A * 11/1995 Tait ..... 116/173
5,702,081 A * 12/1997 Gallemore, II ..... 248/218.4
6,186,454 B1 * 2/2001 Olsen ..... 248/218.4
6,233,858 B1 * 5/2001 Brach, Jr. et al. ..... 40/660
6,338,212 B1 * 1/2002 Santa Cruz et al. ..... 40/607

* cited by examiner

*Primary Examiner*—William L. Miller
(74) *Attorney, Agent, or Firm*—Gowling Lafleur Henderson

(57) ABSTRACT

A sign for mounting to a pole consists of a cradle, a first panel and a second panel. The cradle includes a number of apertures for receiving strapping for securing the cradle to the pole. The cradle also includes a flange positioned at a lower end thereof for supporting the lower end of the first panel. The indicia comprises magnetic indicia, and the first panel is metallic so as to allow the indicia to be detachably secured to the first panel. The first panel includes a hook positioned at the upper end thereof for securing the first panel to the cradle, and the second panel includes a hook positioned at the upper end thereof for securing the second panel to the first panel. A threaded bolt passes through apertures formed in the lower ends of the panels and engages threaded apertures in the cradle so as to secure the panels to the cradle.

8 Claims, 5 Drawing Sheets

POLE-MOUNTED SIGN

FIELD OF THE INVENTION

The present invention relates to a sign for displaying graphic and/or print material. In particular, the present invention relates to a sign which can be coupled to and uncoupled from a pole without damaging or drilling into the pole.

BACKGROUND OF THE INVENTION

Frequently, it is desirable to employ a sign to display graphic and/or print material for advertising or informational purposes. Most often, the signs are positioned on the ground, or secured to a vertical pole. Although ground signs are advantageous in that they may be readily set up, they are prone to falling over particularly when exposed to high wind velocities.

Pole-mounted signs are advantageous in that they can be exposed to high wind velocities without the risk of collapse inherent in ground signs. Further, pole-mounted signs can be elevated far above the ground for added visibility. However, the conventional polemounted sign is permanently secured to the pole by drilling into the pole and securing permanent attachment means. Although the conventional pole-mounted sign may be satisfactory for applications where damage to the pole is not a consideration, it is not suitable for a tenant of a commercial leased premises where the tenant is liable for damages sustained to the premises. Accordingly, there is a need for a sign which can be exposed to high wind velocities and positioned above the ground but without the risk of damage associated with the conventional pole-mounted sign.

SUMMARY OF THE INVENTION

According to the present invention, there is provided a sign for securing to a pole which addresses the deficiencies of the prior art signs.

A sign assembly is provided for mounting to a pole. The sign assembly has a front panel for receiving indicia on a surface thereof, a transparent rear panel positioned adjacent the front panel surface and a cradle for securing the front and rear panel to the pole. The cradle has a connector for releaseably mounting the cradle to the pole without deforrning the pole.

The connector may frictionally engage the pole to clamp the cradle to the pole.

First attachment means may be provided for releaseably attaching the rear panel to the cradle and second attachment means for releaseably attaching the front panel over the rear panel.

The connector may include at least one flexible strap secured to the cradle for encircling the pole.

The fist attachment means may include a first hook for securing an end of the first panel to the cradle and a bolt hole for receiving a bolt for extending through the first panel and threadably engaging the cradle.

The second attachment means may include a second hook for engaging at least one of the cradle end rear panel and a bolt hole for receiving the bolt.

The sign assembly may have two cradles, two rear panels and two front panels, each disposable on opposite sides of the pole.

The sign assembly may include a side apron extending rearwardly from vertical side of each front panel, the side aprons overlapping to conceal the cradles and the pole.

Clips may be provided for connecting adjacent side curtains to each other.

The rear panel may be magnetically attractive and a graphic indicia may include a magnetic rear face.

BRIEF DESCRIPTION OF THE DRAWINGS

The preferred embodiment of the present invention will now be described, by way of example only, with reference to the drawings, in which.

DETAILED DESCRIPTION OF THE PREFERRED EMBODIMENT

Figure 1:
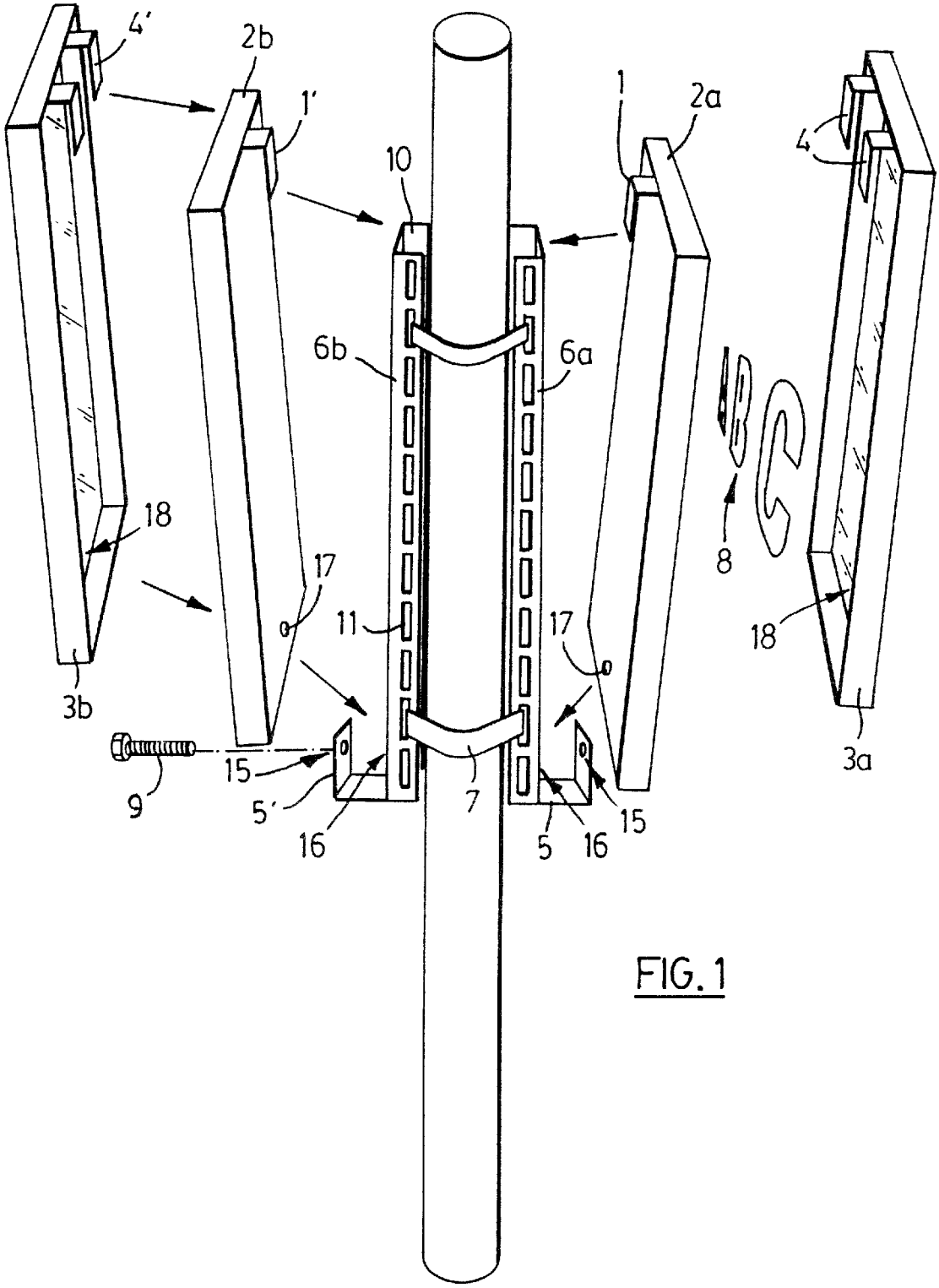
FIG. 1 is a side exploded view of the sign according to the present invention, showing the cradles, the rear panels, the detachable indicia, and the transparent enclosures, with the side apron of each transparent cover removed for clarity.
Figure 2:
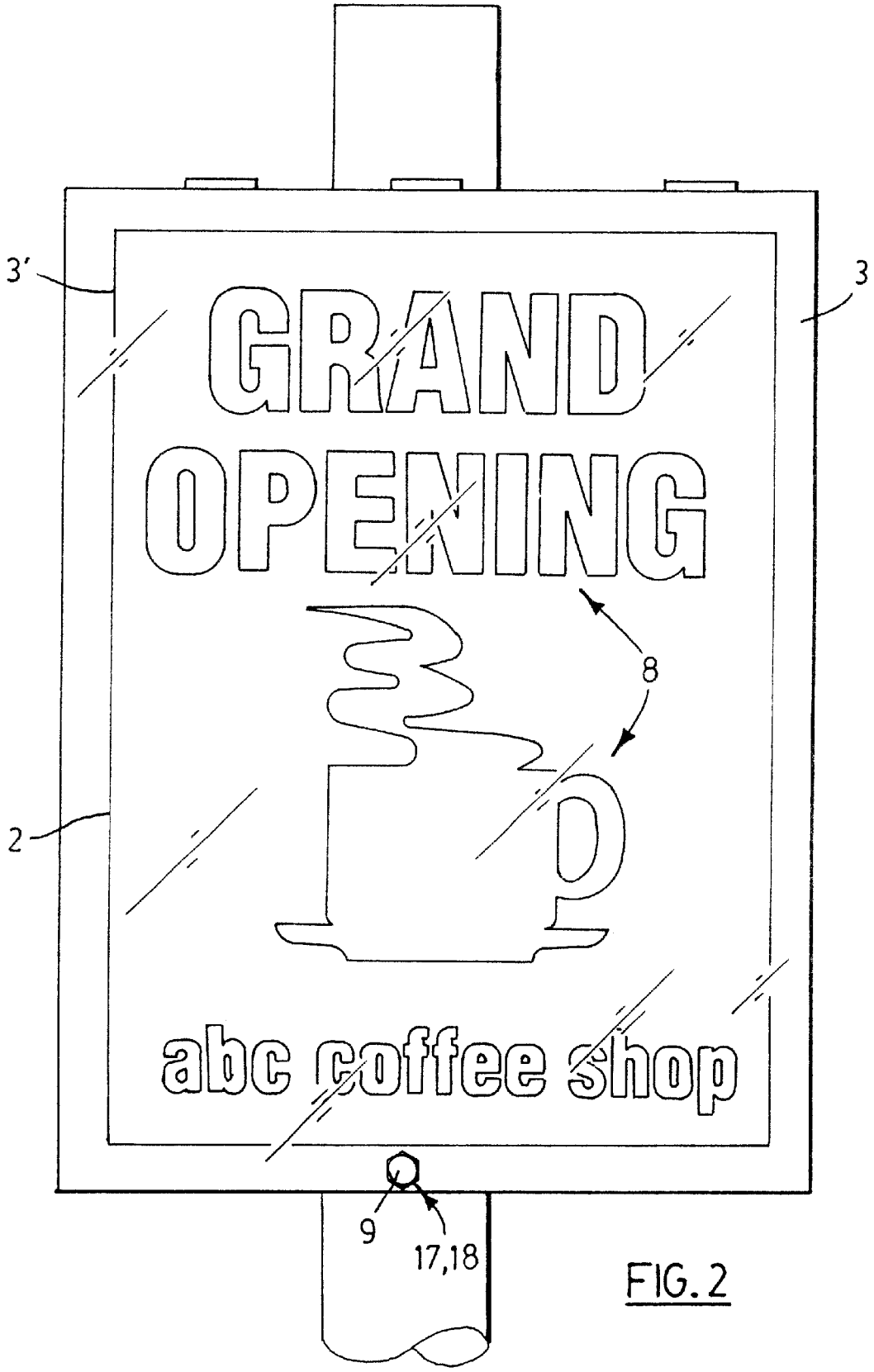
FIG. 2 is a front plan view of the sign shown in FIG. 1.
Figure 3:
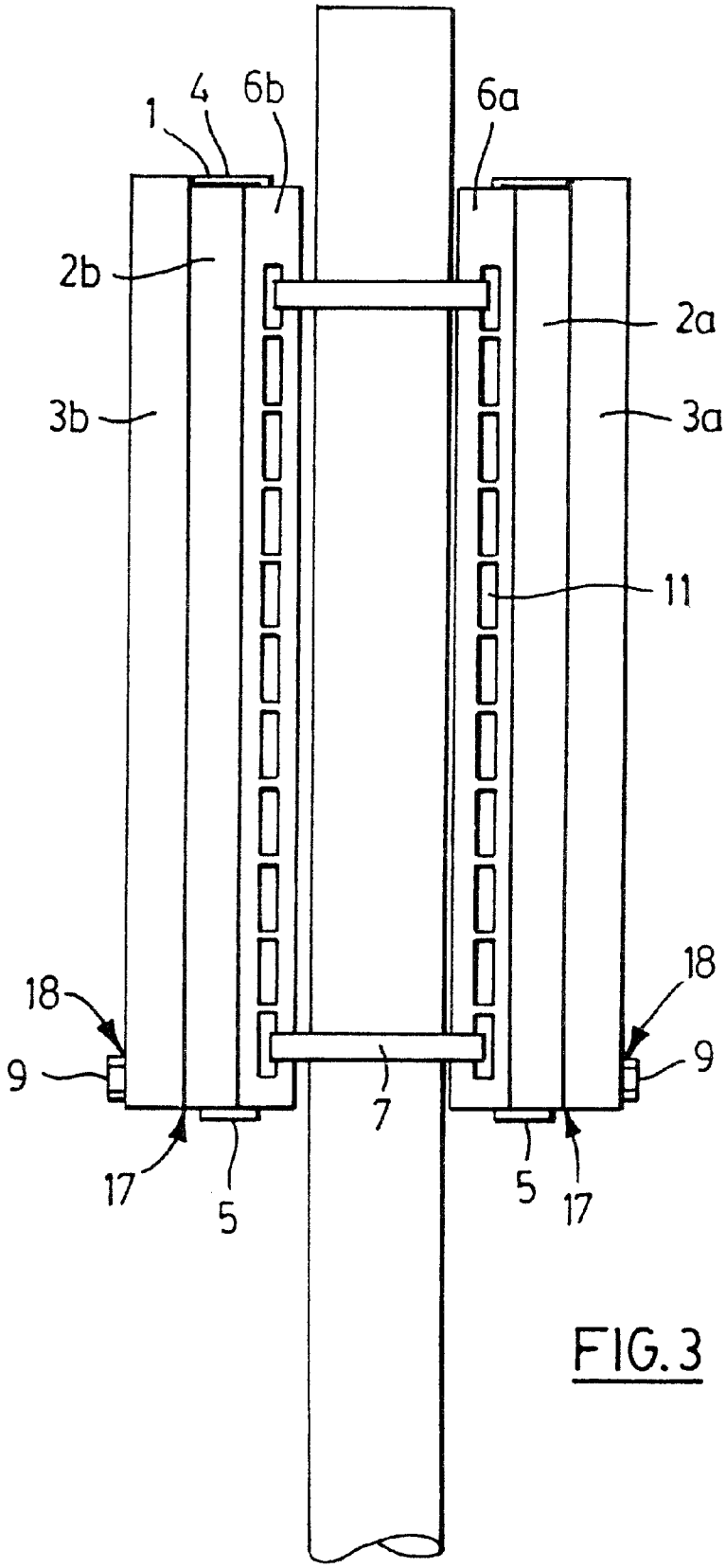
FIG. 3 is a side view of the assembled sign, with the side apron of the transparent cover removed for clarity.

Turning to the drawings, the sign, according to the present invention, is shown comprising a pair of cradles 6*a*, 6*b*, a pair of rear panels 2*a*, 2*b*, detachable indicia 8, and a pair of transparent enclosures 3*a*, 3*b*. Preferably, each cradle 6 is fabricated from galvanized steel, and is shaped as a elongate member having a channel 10 extending the length of the cradle 6. However, it will be appreciated that the cradle 6 may be fabricated from other materials if desired.

Each cradle 6 includes a support flange 5 which extends laterally outwards from the lower end of the cradle 6 and terminates at an upwards-extending end portion 5'. Preferably, the support flange 5 is located at a point on the lower end equidistantly between the vertically-extending side edges of the cradle 6 so as to support the rear panels 2 from their bottom ends without imparting a moment to the rear panels 2. Further, the cradle 6 may include two or more spaced-apart support flanges 5, if desired, to more firmly support the rear panels 2.

Each cradle 6 also includes a first aperture 15 extending through the upwards-extending end portion 5' of the support flange 5, and a second aperture 16 collinear with the first aperture. As will be explained, the first and second apertures, 15 and 16 respectively, are threaded so as to receive a threaded bolt 9 therethrough for securing tbe rear panel 2 and the enclosure 3 to the cradle 6. However, the first and second apertures 15 and 16 and the bolt 9 may be eliminated and replaced with a clasp or other less permanent fasteninmeans if desired.

In addition, each cradle 6 includes a plurality of slots 11 opening into the channel 10, and is secured to a pole through straps 7 extending around the pole and passing through the slots 11. Preferably, the straps 7 comprise flexible steel straps, such as those sold commercially under the brand name Band-It. However, plastic or other suitable straps may be used without departing from the scope of the invention.

Preferably, each rear panel 2 is substantially planar and is fabricated from aluminum for weight reduction. However, the rear panels 2 may be fabricated from plastic or other suitable material, and may adopt an arcuate shape to facilitate viewing of the printed or graphic material from a wide angle.

Each rear panel 2 includes an aperture 17 adjacent the bottom end of each rear panel 2 for receiving the bolt 9, and a hook 1 secured to the upper end of the rear panel 2. Each hook extends laterally inwards from the upper end of the rear panel 2 and tetminates at a downward-extending end portion 1'. Each end portion 1' is shaped for being received in the upper end of the charnel 10 so as to seclre the top end of the rear panel 2 to the cradle 6. Preferably, each hook 1 is located at a point on the upper end of the rear panel 2 equidistantly between the vertically-extending side edges of the rear panel 2 so as to support each rear panel 2 from its top end without imparting a moment to the rear panel 2. Alternately, each rear panel 2 may include two or more spaced-apart hooks 1, if desired, to more firmly support the rear panels 2.

Preferably, the indicia 8 comprises magnetic indicia, and at least one of the rear panels 2 includes a metal sheet extending therethrough for detachably securing the indica 8 to the rear panel 2. In one implementation, the indicia 8 comprises a vinyl coating on a rubber magnetic substrate. However, the indicia 8 may be secured to the rear panel 2 through other means, if desired. For instance, in one variation, the indicia 8 includes an adhesive substrate, while in another variation the indicia 8 is secured to the rear panel 2 through a fastening system such as Velcro (trade-mark). Preferably, the indicia 8 comprises alphanumeric characters for presenting a textual message. However, the indica 8 may also include graphic symbols for added versatility.

Each transparent enclosure 3 comprises a substantially transparent front panel 3' which includes an aperture 18 adjacent the bottoni end of the front panel 3 for receiving the bolt 9. Preferably, the front panel 3' is substantially planar and is fabricated from a steel mesh so at to allow the indicia 8 to be viewed through the enclosure 8 without significant glare. However, the front panel 3' may be fabricated from plastic or other suitable material, and may adopt an arcuate shape if the panels 2 are also arcuately shaped. Further, the front panel 3' may have an opaque colour and/or comprise a lens for magnifying the indicia 8 for added versatility.

Figure 4:
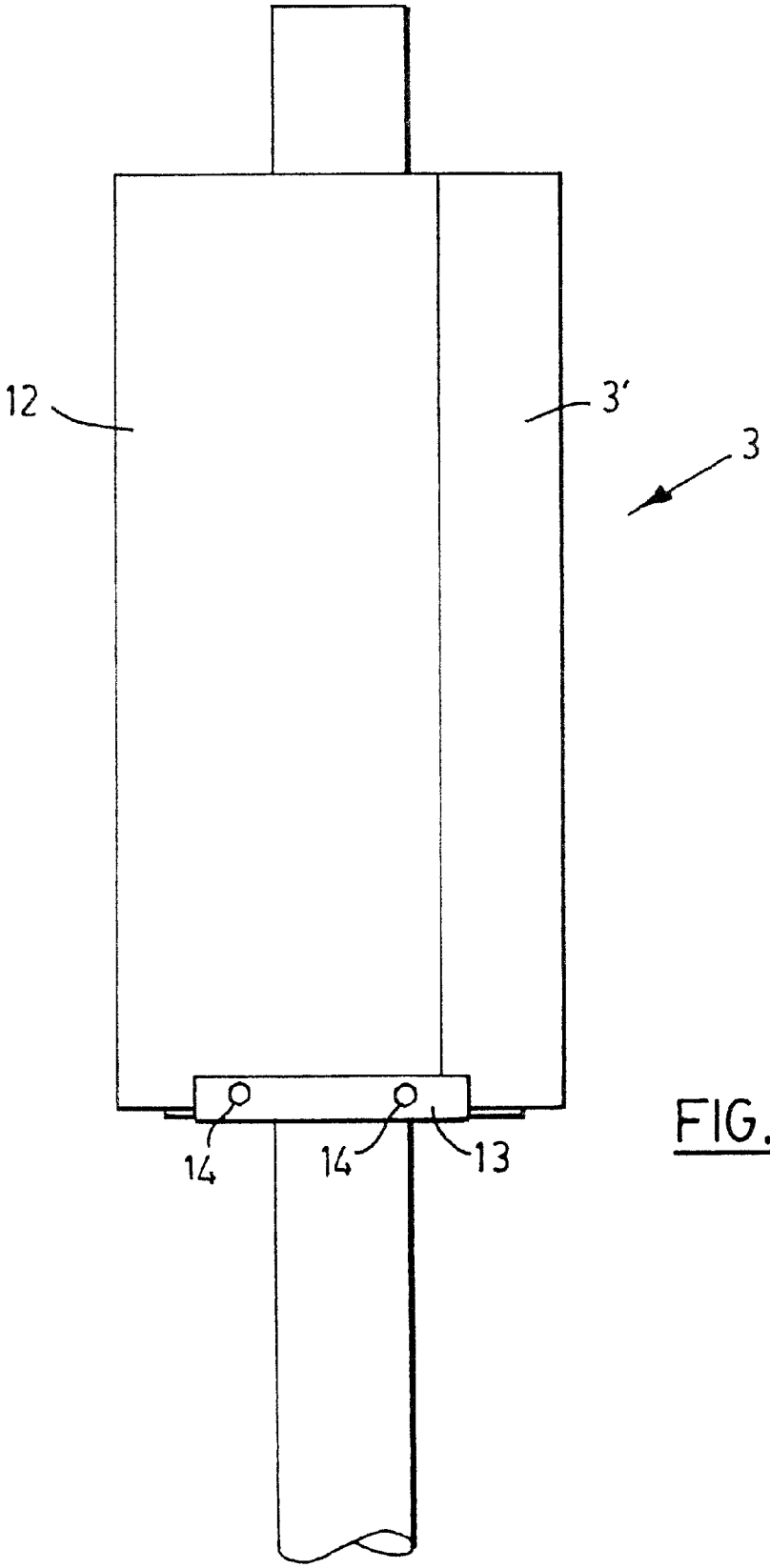
FIG. 4 is a side view of the assembled sign, with the side apron shown.
Figure 5:
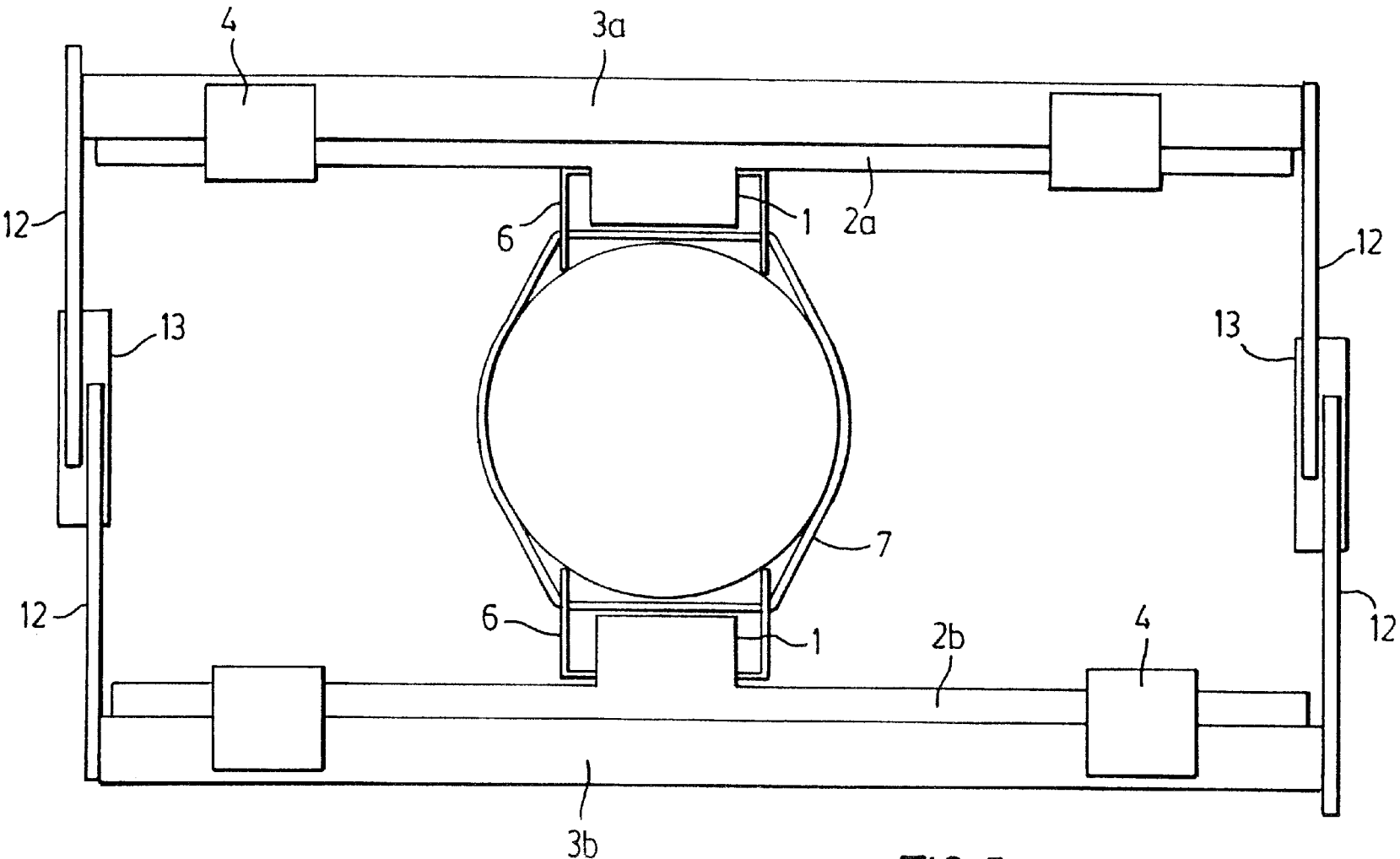
FIG. 5 is a top view of the assembled sign.

Preferably, each transparent enclosure 3 includes a side apron 12 (shown in FIGS. 4 and 5) extending from the vertically-extending side edges of the front panel 3'. Each side apron 12 is substantially planar, and extends rearwardly from the front panel 3'. Preferably, the side aprons 12 overlap somewhat so as to conceal the cradles 6, the rear panels 2, and the straps 7 from view. However, it should be understood that the side aprons 12 may be eliminated where concealment of the cradles 6, the rear panels 2, and the straps 7 is not critical.

For added stability, the side aprons 12 of one of the enclosures 3 are secured to the side aprons 12 of the other of the enclosures 3 through clip 13. Preferably, the clips 13 are secured to the side aprons 12 through bolts 14. However, the clips 13 may also be press fit if desired. Further, since it is desirable for the sign to be positioned a substantial height from the ground, prcferably the clips 13 are positioned at the bottom ends of the side aprons 12. However, the clips 13 may be positioned at the top ends of the side aprons or replaced with oher suitable apron securing means without departing from the scope of the invention.

Each enclosure 3 includes a pair of spaced-apart hooks 4 secured to the upper end of the front panel 3', which extend laterally inwards from the upper end of the front panel 3' and terminate at respective downward-extending end portion 4'. Each end portion 4' is shaped for extending over the upper end of the rear panel 2 so as to secure the top end of the front panel 3' to the rear panel 2 and to position the front panel 3' in close proximity to the rear panel 2 for protecting the indicia 8 positioned therebetween.

To use the sign, preferably the indicia 8 are first applied to at least one of the panels 2. The cradle **6*a* and the cradle 6*b* are then applied to opposite sides of a pole, a distance above the ground, and then secured to the pole by tightening the straps 7. The rear panels 2 are then secured to the cradles 6 by positioning the rear panels 2 against the cradles 6, with the bottom end of the rear panels 2 being positioned above the respective support flange 5. The rear panels 2 are then lowered until the hooks 1 engage the top ends of the channels 10 of the cradles 6, and the bottom ends of the panels 2 are received between the cradle 6 and the upwards-extending end portion 5' of the support flange 5**.

The enclosures 3 are then secured to the panels 2 by first positioning the front panels 3' in proximity to the rear panel 2, and the side aprons 12 on opposite sides of the rear panels 2. The enclosures 3 are then lowered until the hooks 4 engage the top ends of the rear panels 2. The threaded bolts 9 are then passed through the apertures in each of the front and rear panels 3', 2, and then screwed into the first and second apertures of the cradle 6 and the upwards-extending end portion 5' of the support flange 5 until the bottom ends of the front and rear panels 3', 2 are secured to the cradle 6. Preferably, each bolt 9 has a head, of the type well known to those skilled in the art, which prevents the bolts 9 from being removed except with the use of specialty tools.

Finally, the overlapping portions of the side aprons 12 are fastened together by pressing the clips 13 against the bottom edges of the overlapping portions of the side aprons 12, and then tightening the bolts 14.

To remove the sign from the pole, the enclosures 3, the rear panels 2 and the cradles 6 are removed from the pole in the reverse order they were assembled. Since none of the bolts 9, 14 pierce the pole, and since the straps 7 only grasp the circumference of the pole without cutting into it, the sign can be repeatedly installed and removed without damage to the pole. Further, since the sign employs detachable indicia 8, the message conveyed by the sign can be quickly modified.

The foregoing description is intended to be illustrative of the preferred embodiment of the invention. Those of ordinary skill may envisage certain additions, deletions, and/or modifications to the described embodiment which do not depart from the scope and spirit of the present invention as defined by the appended claims.

We claim:

1. A sign assembly for mounting to a pole comprising:

a cradle;

a connector for releasably clamping said cradle to said pole;

a rear panel for receiving graphic indicia on a surface thereof;

first attachment means for releasably attaching said rear panel to said cradle;

a transparent front panel for covering said rear panel and inhibiting removal of said graphic indicia from said rear panel;

second attachment means for releasably attaching said front panel over said rear panel;

wherein said connector includes at least one flexible strap secured to said cradle for encircling said pole; and, said first attachment means includes a first hook for securing an end of said rear panel to said cradle and a bolt hole for receiving a bolt for extending through said rear panel and threadedly engaging said cradle.

2. A sign assembly as claimed in claim 1 Wherein:

said second attachment means includes a second hook for engaging at least one of said cradle and said rear panel and a bolt hole for receiving said bolt.

3. A sign assembly as claimed in claim 2 further having:

two of said cradle, two of said rear panel, and two of said front panel of each disposable on opposite sides of said pole.

4. A sign assembly as claimed in claim 3 further having:

a side apron extending rearwardly from vertical sides of each said front panel, said side aprons overlapping to conceal said cradles and said pole.

5. A sign assembly as claimed in claim 4 further having:

clips for connecting adjacent said side aprons to each other.

6. A sign assembly as claimed in claim 5 wherein:

said rear panel is magnetically attractive and said graphic indicia include a magnetic rear face.

7. A sign assembly as claimed in claim 2 wherein:

said rear panel is magnetically attractive and said graphic indicia include a magnetic rear face.

8. A sign assembly as claimed in claim 3 wherein:

said rear panel is magnetically attractive and said graphic indicia include a magnetic rear face.

* * * * *